United States Patent [19]

Lamarque

[11] 4,347,400

[45] Aug. 31, 1982

[54] APPARATUS FOR REHEATING MOLTEN STEEL IN LADLES

[75] Inventor: Gabriel Lamarque, Paris, France

[73] Assignee: Stein Heurtey, Ris Orangis, France

[21] Appl. No.: 195,059

[22] Filed: Oct. 7, 1980

[30] Foreign Application Priority Data

Oct. 11, 1979 [FR] France ..... 79 25293

[51] Int. Cl.[3] ..... H05B 7/00

[52] U.S. Cl. ..... 373/77; 373/95

[58] Field of Search ..... 13/31 R, 14–17

[56] References Cited

U.S. PATENT DOCUMENTS 3,549,773 12/1970 Rossdorf et al. ..... 13/31 R 4,216,347 8/1980 Holtermann et al. ..... 13/31 R X

*Primary Examiner*—Roy N. Envall, Jr.

*Attorney, Agent, or Firm*—Wenderoth, Lind & Ponack

[57] ABSTRACT

An apparatus for reheating molten steel in a ladle under a shielded gaseous atmosphere comprises a vertically movable electrode housing, a lower portion of which extends through a tight passage formed in the ladle cover or in the cover of a ladle-containing vessel. This passage comprises a hollow water-cooled jacket or belt assembly surrounding the housing and provided with recesses for scraper rings and a packing and connected, through a flexible and vacuum-tight coupling, to a flanged collar rigid with the cover. Stacked refractory rings of insulating material are interposed between the belt and the flanged collar. The packing may be replaced by an inflated flexible tubular torus. A conduit is provided for supplying lubricant to the surfaces in mutual sliding contact.

5 Claims, 3 Drawing Figures

APPARATUS FOR REHEATING MOLTEN STEEL IN LADLES

BACKGROUND OF THE INVENTION

The present invention relates to improvements in or relating to apparatus for reheating molten steel in a ladle and under a shielding gaseous atmosphere. It is known that modern methods of reheating molten steel in a ladle before an actual casting operation requires, as a rule, the vacuumization of the metal, the heating electrodes being kept in their raised position, for example, in the absence of any metal-heating electric arc.

Therefore, such reheating apparatus must be so constructed that the ladle, its cover and the electrode housings constitute a sealed assembly. On the other hand, they must also enable the electrode to travel vertically and to pass through the ladle cover or the ladle containing vessel, while preserving a tightness such that, during the downward movement under degassing pressure (of the order of 0.5 to 1 torr, for example), no appreciable leakage occurs.

SUMMARY OF THE INVENTION

It is the primary object of this invention to provide an apparatus of the type set forth which is capable of meeting the above mentioned contradictory requirements without interfering with the proper operation of the plant during the reheating phase and without impairing the necessary sturdiness of the apparatus. With these objects in view, the apparatus must meet the following requirements:

- the electrode movement must be free of any impediment during the reheating phases and regulated for assuring, as conventional in electric arc furnaces, a constant delivery of active power;
- during the same phases, the electrode movement must be free of any stress likely to involve a breakage of the graphite electrode; and,
- the length of the electrode shaft must be as reduced as possible, in order to provide the highest possible resistance to electrodynamic stress, thus minimizing the risks of breaking the electrode.

Therefore, the present invention relates to an apparatus for reheating molten steel in a ladle under a shielded gaseous atmosphere, of the type wherein each heating electrode is enclosed in a movable sealed housing of which the lower portion extends through a fluid-tight passage formed in the cover of the ladle or ladle-containing vessel or tank, this arrangement being characterized in that the tight passage consists of a water-cooled hollow jacket or belt assembly surrounding the housing and provided with annular recesses for the seals, such assembly being connected, through a flexible and vacuum-tight coupling, to a flange collar rigid with the cover.

According to an essential feature characterizing this invention, a plurality of stacked refractory rings of insulating material are interposed between the water-cooled hollow assembly and the flanged collar for limiting in the compression direction the permissible vertical movements of the coupling.

It is a further feature characterizing this invention to provide an apparatus of the type set forth wherein an external array of traction rods and springs is disposed between the water-cooled hollow assembly and the flanged collar for limiting, in the extension direction, the permissible vertical movements of the flexible coupling.

Still according to the present invention, the water-cooled hollow assembly comprises on the one hand, annular recesses for receiving scraper rings, and, on the other hand, a single annular recess for a packing, a conduit with a removable plug being also provided for delivering lubricant to the surfaces in mutual sliding contact of the assembly and of the movable electrode housing.

In a modified version of this invention, the belt assembly packing is a tubular inflatable torus-shaped member adapted to receive a fluid under pressure so as to be applied against the electrode housing, when operating under low-pressure conditions, and to retract and collapse, when deflated, during the electrode housing movements.

BRIEF DESCRIPTION OF THE DRAWINGS

Other features and advantages of this invention will appear as the following description proceeds, with reference to the attached drawings.

In the drawings.

DETAILED DESCRIPTION OF THE INVENTION

Figure 1:
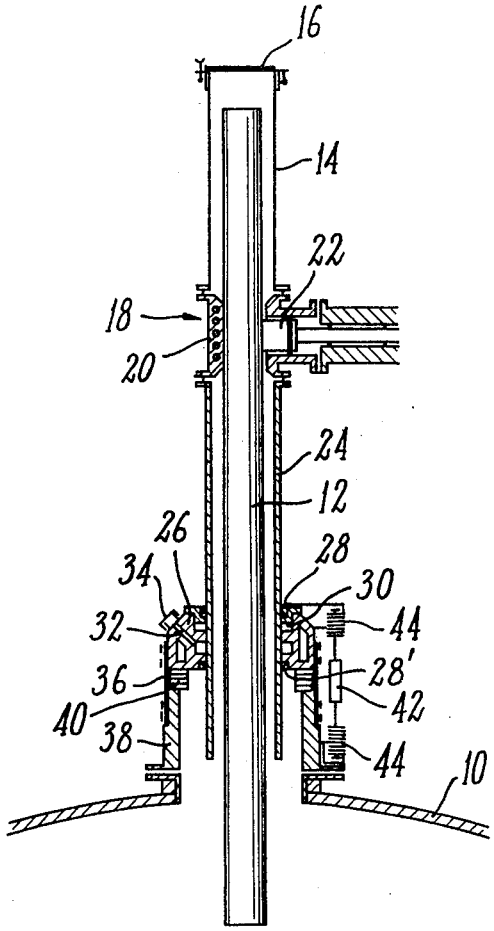
FIG. 1 is a diagrammatic axial vertical section showing a typical embodiment of the invention
Figure 3:
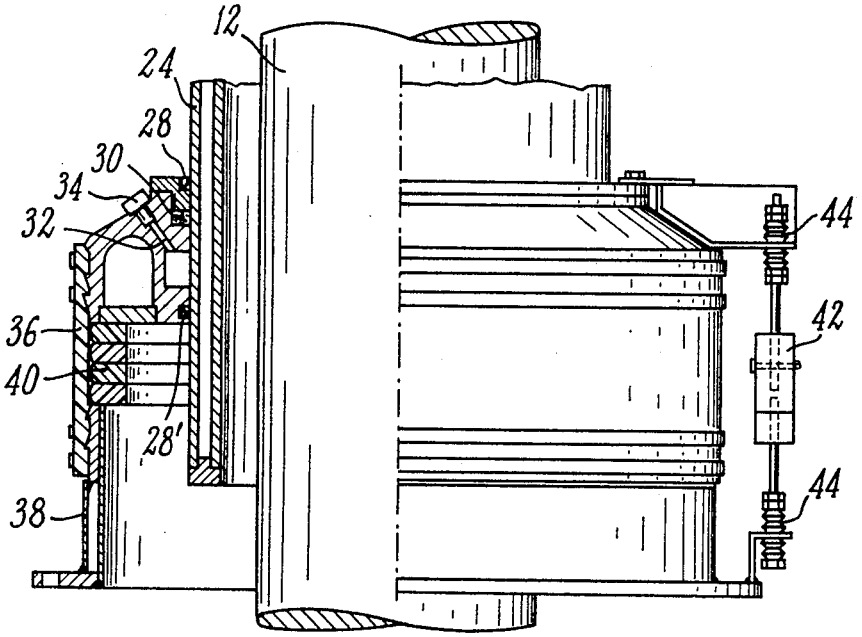
FIG. 3 is a fragmentary enlarged vertical section illustrating the structure of FIG. 1 in more detail.

Referring first to the embodiment illustrated in FIGS. 1 and 3 the reference numeral 10 designates the topmost portion of the cover of a ladle, or of the ladle containing vessel, and 12 is one of the heating electrodes. Each electrode 12 is enclosed in a housing made of three axially aligned sections, i.e.:

- an upper section 14, constituting a reserve housing receiving the nonused portion of electrode 12. In fact, it is well known in the art that this electrode is fed gradually downwards in the electrode holder as the electrode tip is consumed, the consumption of an entire electrode section being attended by the fixing of a fresh section by means of a nipple. Access to this uppermost section 14 can be had after removal of an autoclave lid 16; an intermediate section 18, comprising a water-cooled vacuum-tight copper holdfast clamp 20 provided with a push member 22 extending a right angles to the electrode axis for supporting the electrode and supplying electric current thereto (to simplify the drawing, neither the electric supply means nor the electrode driving device are shown);
- a lower section 24 in the form of a water-jacket, enclosing the useful section of electrode 12. The length of this lower section 24 is such that the electrode can move vertically therein without impairing the fluidtightness. Surrounding this lower section 24 of the electrode housing is the device which, according to the present invention, permits the sealed passage of the electrode housing through the cover 10 of the ladle, or of the ladle-receiving vessel or tank.

This device, through which the electrode housing (14, 18, 24) is adapted to slide, comprises a hollow, water-cooled jacket or belt assembly 26 surrounding housing 24 and; provided with annular recesses or grooves receiving a pair of scraper rings 28, 28', and a packing 30, respectively. A conduit such as 32 are also provided for feeding lubricant to facilitate the easy sliding of the electrode housing of electrode 12 through this assembly 26, conduit 32 being adapted to be closed, between lubricating periods, by a plug 34 provided with a tight gasket. The device further comprises a flexible coupling member 36 interposed between a flanged collar 38, adapted to be rigidly fixed to the cover 10, and assembly 26. This flexible coupling member 36, crimped on the one hand to the assembly 26, and, on the other hand, to the top of collar 38, consists of flexible, vacuum-tight material.

According to a specific feature characterizing this invention, the vertical movement of the flexible coupling 36 is limited, in the crushing or compression direction, by a plurality of stacked refractory rings 40 of insulating material interposed between the assembly 26 and flanged collar 38. On the other hand, the vertical movement of this flexible coupling is limited, in the extension direction, by a plurality of spaced traction rod and spring assemblies, designated by the reference numerals 42 and 44 in the drawing.

The flexible, vacuum-tight coupling 36 is thus adapted to compensate relative for distortions occuring in actual service between the cover 10 and the electrode guiding and driving means.

Figure 2:
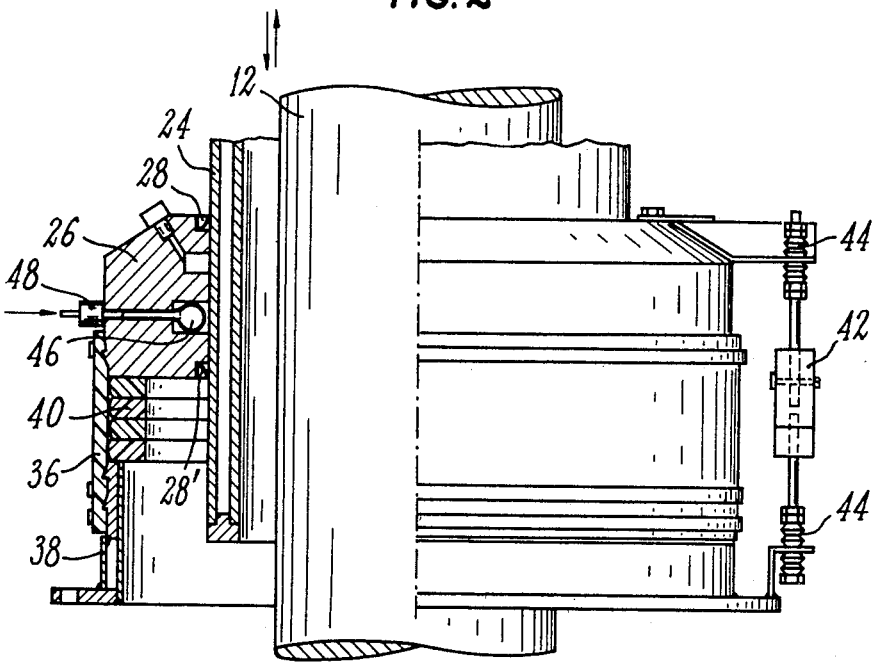
FIG. 2 is a fragmentary enlarged vertical section showing a modified embodiment of the invention.

The modified embodiment illustrated in FIG. 2 is directed to prevent any premature wear and tear of the belt assembly packing during the reheating phases attended by a movement of the electrode housing, and also to preserve the efficiency of the fluid-tightness resulting from the action of scraper rings 28 and 28'. In this embodiment, a flexible inflatable tubular torus 46 is substituted for the packing 30 and is connected to a fluid supply 48. Thus, during the downward movement of the low-pressure electrode housing, the tightness can be improved by simply inflating this member 46.

Of course, the present invention should not be construed as being strictly limited by the specific embodiment described and illustrated herein, since many modifications may be brought thereto without departing from the basic principles of the invention as set forth in the appended claims.

What is claimed as new is:

1. In an apparatus for reheating molten steel in a ladle under a shielding gaseous atmosphere, said apparatus being of the type including at least one fluid-tight electrode housing supporting an elongated electrode and movably extending through a cover of the ladle or of a vessel containing the ladle, and means for sealing the exterior of said housing and thereby for preventing leakage from said cover during relative movement of said housing with respect to said cover, the improvement wherein said sealing means comprises:

a hollow, water-cooled jacket assembly surrounding said housing, said assembly having therethrough a passage through which said housing extends, said assembly having therein annular recesses receiving at least one annular packing contacting the exterior of said housing and at least one annular scraper blade contacting the exterior of said housing;

a collar rigid with said cover;

a flexible, vacuum tight coupling connecting said assembly to said collar; and means for limiting movement of said coupling in opposite directions axially of said housing.

2. The improvement claimed in claim 1, said limiting means comprises annular refractory members of insulating material stacked between said assembly and said collar, thereby limiting compression movement of said coupling.

3. The improvement claimed in claims 1 or 2, wherein said limiting means comprises a plurality of assemblies of traction rods and springs connected between said assembly and said collar, thereby limiting extension movement of said coupling.

4. The improvement claimed in claim 1, wherein said assembly further includes an annular groove, and conduit means for supplying a lubricant to said groove, and thereby for lubricating mutual sliding surfaces of said housing and said assembly.

5. The improvement claimed in claim 1, wherein said packing comprises an inflatable torus-shaped hollow member, and further comprising means for inflating said hollow member such that said hollow member tightly seals against the exterior of said housing.

* * * * *